US005911248A

United States Patent [19]

Keller

[11] Patent Number: 5,911,248

[45] Date of Patent: Jun. 15, 1999

[54] GASOLINE DISPENSER AND CABLE ASSEMBLY FOR PREVENTING VAPOR FLOW

[75] Inventor: Timothy Robert Keller, Salisbury, Md.

[73] Assignee: Dresser Industries, Inc., Dallas, Tex.

[21] Appl. No.: 08/909,261

[22] Filed: Aug. 11, 1997

[51] Int. Cl.[6] ..... B65B 31/00

[52] U.S. Cl. ..... 141/59; 141/83; 174/84 C

[58] Field of Search ..... 141/83, 59, 94; 174/84 C

[56] References Cited

U.S. PATENT DOCUMENTS

| | | | |
|---|---|---|---|
| 2,799,721 | 7/1957 | Floyd, Jr. | 174/84 C |
| 2,828,353 | 3/1958 | Adams et al. | 174/84 C |
| 2,882,333 | 4/1959 | Bertaux | 174/84 C |
| 4,253,729 | 3/1981 | Rocton . | |
| 4,326,094 | 4/1982 | Hunn . | |
| 4,394,531 | 7/1983 | Delabie . | |
| 4,415,223 | 11/1983 | Asick . | |
| 4,419,157 | 12/1983 | Ferrentino . | |
| 4,593,175 | 6/1986 | Bowser et al. . | |
| 4,787,704 | 11/1988 | Knecht et al. . | |
| 5,004,868 | 4/1991 | Singor . | |
| 5,071,221 | 12/1991 | Fujitani et al. . | |
| 5,095,175 | 3/1992 | Yoshida et al. . | |
| 5,187,968 | 2/1993 | Beetz et al. . | |
| 5,195,352 | 3/1993 | Grois et al. . | |
| 5,210,376 | 5/1993 | Caviar . | |
| 5,271,081 | 12/1993 | Khalil . | |
| 5,281,757 | 1/1994 | Marin et al. . | |
| 5,281,763 | 1/1994 | Hey et al. . | |
| 5,317,664 | 5/1994 | Grabiec et al. . | |
| 5,345,979 | 9/1994 | Tucker et al. | 141/59 |
| 5,373,100 | 12/1994 | Arroyo et al. . | |
| 5,417,256 | 5/1995 | Hartsell, Jr. et al. | 141/59 |
| 5,451,718 | 9/1995 | Dixon . | |
| 5,475,782 | 12/1995 | Ziebol . | |
| 5,536,904 | 7/1996 | Kojima et al. . | |

*Primary Examiner*—Steven O. Douglas
*Attorney, Agent, or Firm*—Haynes and Boone, L.L.P.

[57] ABSTRACT

A gasoline dispenser, and cable assembly utilized therein, in which the cable assembly is formed by a plurality of conductors, a sheath of insulative material extending around each conductor, and a sleeve extending over a portion of the jacket. The sleeve is crimped over the jacket to compress the jacket and sheaths to reduce the passage of vapor through the cable assembly. The cable assembly is connected between two components in the dispenser to prevent the flow of gasoline vapor from one component to the other.

11 Claims, 1 Drawing Sheet

GASOLINE DISPENSER AND CABLE ASSEMBLY FOR PREVENTING VAPOR FLOW

BACKGROUND OF THE INVENTION

The present invention relates to a gasoline dispenser and a cable assembly for preventing the passage of vapor from one zone of the dispenser to the other, and more particularly, to such a gasoline dispenser and cable assembly in which the outer jacket of the cable assembly is crimped radially inwardly to block vapor flow between the conductors in the assembly.

In the dispensing of gasoline from service stations, one or more gasoline dispensers are provided having a plurality of nozzles that dispense the gasoline into the vehicles. Since electrical apparatus, such as switches, coils, pulsers, etc. are included in the dispenser, precautions have to be taken to avoid the hazard of an electrical spark igniting the fuel vapors that accumulate around components of the dispenser, including the gasoline flow meter. For example, according to several prior art designs, the dispenser is divided into a first zone that contains the gasoline flow meter, and its associated hydraulic apparatus; and a second zone that contains the associated electrical apparatus. The first zone is usually classified, i.e., it is rendered explosion-proof by use of an explosion-proof housing, or the like, and the two zones are separated by a vapor barrier, which can be in the form of a seal, an air gap, or the like.

In all of these designs, electrical cables have to be passed from the gasoline flow meter in the classified zone, through the vapor barrier, and to the electrical apparatus in the other zone. These electrical cables often contain a plurality of insulated electrical conductors bundled together and surrounded by an outer jacket of insulative material. It has been discovered that, despite the provision of explosion-proof housings, vapor barriers, and the like, gasoline vapor can still pass through the cable from the classified zone in which the gasoline flow meter is placed to the unclassified zone containing the electrical apparatus. This vapor flow can be sufficient to create a hazardous condition in the unclassified zone and could cause an explosion.

Therefore, what is needed is a gasoline dispenser and an apparatus and method for preventing the flow of gasoline vapor through an electrical cable assembly connecting a gasoline vapor source to an electrical device.

SUMMARY OF THE INVENTION

The present invention, accordingly, provides an apparatus and method for preventing the flow of vapor through a cable assembly. To this end, a sleeve is placed over the outer jacket of the cable assembly and is crimped over the jacket to reduce the spaces between the electrical conductors within the jacket, and thus prevent, or at least substantially reduce, the flow of vapor through the cable assembly.

Thus, a major advantage is achieved with the apparatus and method of the present invention since the cable assembly can be connected in a gasoline dispenser between a gasoline flow meter and its associated electrical apparatus while preventing the flow of gasoline vapor from the flow meter, through the cable, to the electrical apparatus. Also, the apparatus of the present invention requires only one part and can be easily and quickly installed.

DESCRIPTION OF THE PREFERRED EMBODIMENT

Figure 1:
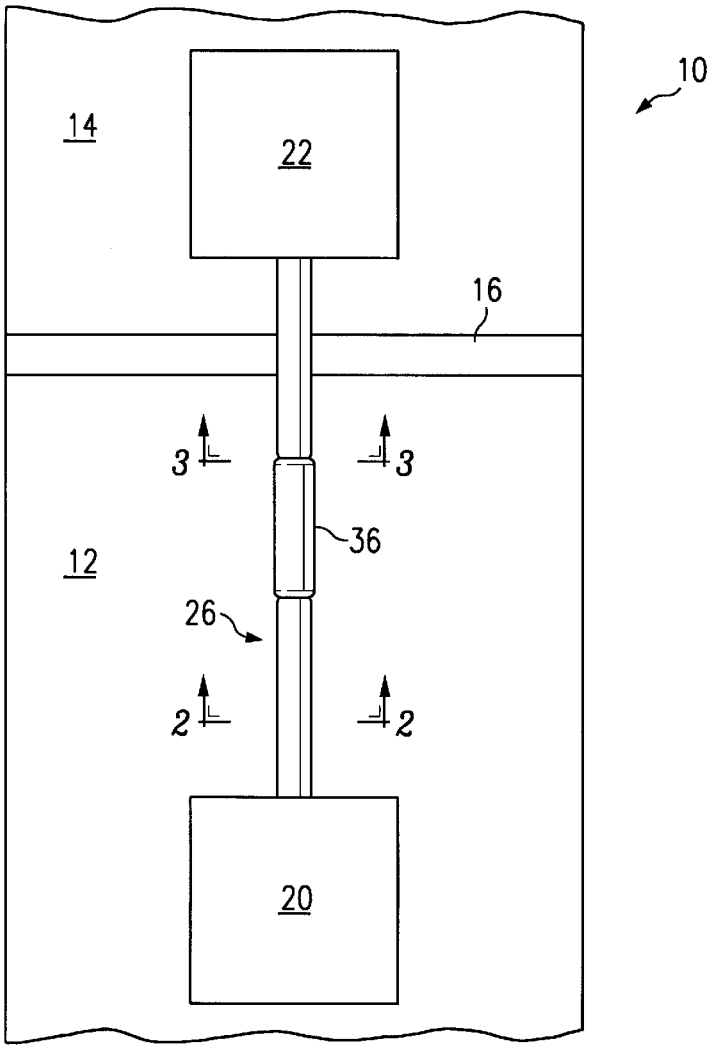
FIG. 1 is a partial schematic view of a gasoline dispenser and a partial, enlarged, isometric view of an electrical cable assembly of the present invention disposed in the dispenser.

Referring to FIG. 1 of the drawing, the reference numeral 10 refers, in general, to a gasoline dispenser, shown partially and schematically, which is divided into two zones 12 and 14 by a vapor barrier 16. A gasoline flow meter 20 is disposed in the lower zone 12 through which gasoline flows from an underground tank (not shown) to the vehicle being serviced. It is understood that the zone 12 can be defined by an explosion proof housing or other apparatus to render it intrinsically safe.

An electrical device 22, which can be in the form of an operating coil for the meter 20, a pulser and/or the like, is disposed in the upper zone 14. The vapor barrier 16 can be in the form of a plate, a seal, an air gap, or the like, that forms a barrier to the passage of gasoline vapor that may accumulate in the zone 12 to the zone 14. Since the dispenser 10, the vapor barrier 16, the meter 20, and the electrical device 22 are all conventional and well documented in the prior art, they are shown only schematically and will not be described in any further detail.

Figure 2:
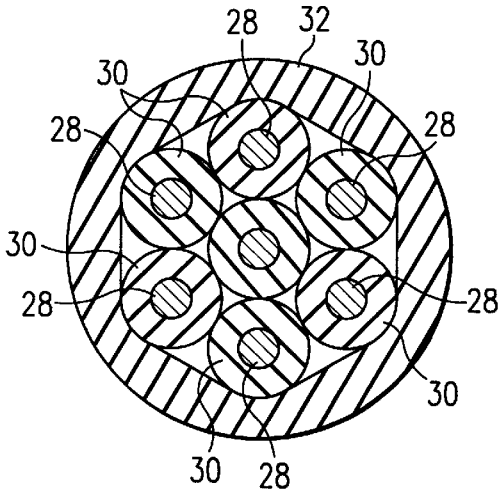
FIGS. 2 and 3 are enlarged cross-sectional views taken along the lines 2—2 and 3—3, respectively, of FIG. 1.

A cable assembly 26 extends from the meter 20 in the zone 12 of the dispenser 10, through an appropriate opening extending through the vapor barrier 16, and to the electrical device 22 in the zone 14, and is shown enlarged in FIG. 1 in the interest of clarity. As shown in FIG. 2, the cable assembly 26 is formed by a bundle of seven electrical conductors 28 having insulative outer sheaths 30, respectively, extending over the outer surfaces thereof. The conductors 28 can be disposed in a parallel relationship or can be twisted around each other, in a conventional manner.

An outer cylindrical jacket 32 extends over the insulated conductors 28 and is formed of an insulative material. Although not shown in the drawings, it is understood that the respective end portions of the jacket 32, as well as the corresponding end portions of the sheaths 30, are stripped to expose the corresponding end portions of the conductors 28. This permits the conductors 28 to be connected to corresponding terminals of the meter 20 and the electrical device 22 in a conventional manner.

As shown in FIG. 2, in the normal configuration of the cable assembly 26, spaces are formed between the outer surfaces of the adjacent sheaths 30 and between some of the sheaths and the inner surface of the jacket 32. As a result, any vapor forming in the zone 12 as a result of the flow of gasoline through the meter 20 will pass through these spaces for the length of the cable assembly 26 and to the zone 14 thus creating a hazardous condition in the latter zone due to the presence of the electrical device 22.

Figure 3:
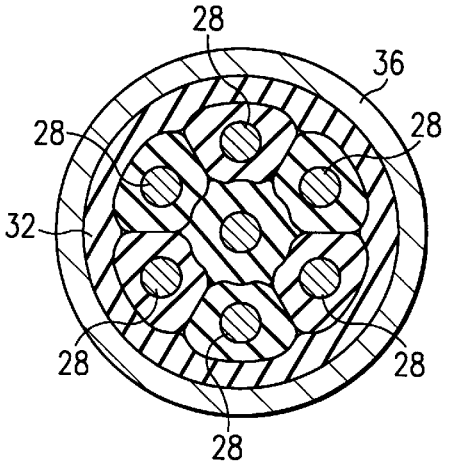

According to a feature of the present invention, a crimp sleeve 36 is provided that extends over an outer surface portion of the jacket 32 of the cable assembly 26 located in the zone 12. The sleeve 36 is preferably fabricated from metal and is crimped at its respective end portions in any known manner, such as by a crimping tool, or the like, to compress the jacket 32, and therefore the conductors 28 and the sheaths 30 together so that they take the form shown in FIG. 3. As a result of this crimping, the spaces between the sheaths 30, and between the latter sheaths and the jacket 32 have been eliminated, or at least substantially reduced.

The present invention thus enjoys several advantages. For example, the cable assembly 26, in its crimped condition shown in FIG. 3, prevents the flow of gasoline vapor through the cable assembly from the flow meter 20 to the electrical device 22. Also, the apparatus and method of the present invention requires only one part and can be easily and quickly installed. It is understood that variations may be made in the foregoing without departing from the scope of the present invention. For example, the present invention is not limited to a gasoline dispensing environment, but is equally applicable to other applications in which it is desirable to prevent the flow of any type of fluid through an electrical cable assembly. Also, the particular type of cable assembly utilized can vary within the scope of the invention. For, example the cable assembly could consist of a plurality of fibre optic conductors bundled together.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A gasoline dispenser for dispensing fuel to a vehicle, the dispenser comprising a housing defining two zones separated by a vapor barrier; a flow meter disposed in one of the zones for metering the flow of fuel to the vehicle; an electrical device disposed in the other zone and associated with the meter; and a cable assembly electrically connecting the flow meter to the electrical device; the cable assembly comprising a plurality of conductors, a sheath of insulative material extending around each conductor, the inner surface of the sleeve being in contact with the corresponding surfaces of the sheaths of the corresponding conductors and pressing adjacent sheaths together in contact without destroying the individual electrical conducting characteristics of each conductor.

2. The dispenser of claim 1 wherein the sleeve is crimped to a size that establishes and maintains the contact without destroying the individual electrical conducting characteristics of each conductor.

3. The dispenser of claim 2 where the sleeve compresses the sheaths.

4. The dispenser of claim 2 herein the sleeve is crimped at its respective ends.

5. A cable assembly comprising a plurality of conductors, a sheath of insulative material extending around each conductor, and a sleeve of a relatively rigid material crimped over the sheaths, the inner surface of the sleeve being in contact with the corresponding surfaces of the sheaths of the corresponding conductors and pressing adjacent sheaths together in contact without destroying the individual electrical conducting characteristics of each conductor.

6. The assembly of claim 5 wherein the sleeve is crimped to a size that establishes and maintains the contact without destroying the individual electrical conducting characteristics of each conductor.

7. The assembly of claim 6 where the sleeve compresses the sheaths.

8. The assembly of claim 6 wherein the sleeve is crimped at its respective ends.

9. A method of electrically connecting a unit exposed to a vapor to an electrical device associated with the unit, the method comprising the step of placing a sheath over of a plurality of electrical conductors to insulate each conductor, connecting the respective ends of the conductors between the unit and the electrical device, placing at least one relatively rigid sleeve over the sheaths, crimping the sleeve so that the inner surface of the sleeve contacts the corresponding surfaces of the sheaths of the corresponding conductors and presses adjacent sheaths together in contact without destroying the individual electrical conducting characteristics of each conductor, thus reducing the flow of vapor from the first unit, through the cable assembly and to the electrical device.

10. The method of claim 9 wherein the step of crimping compresses the sheaths.

11. The method of claim 10 wherein the sleeve is crimped at its respective ends.

* * * * *